US005815888A

United States Patent [19]

Temburg

[11] Patent Number: 5,815,888

[45] Date of Patent: Oct. 6, 1998

[54] APPARATUS FOR EXCHANGING COILER CANS AT A FIBER PROCESSING TEXTILE MACHINE

[75] Inventor: Konrad Temburg, Mönchengladbach, Germany

[73] Assignee: Trützschler GmbH & Co. KG, Mönhengladbach, Germany

[21] Appl. No.: 889,148

[22] Filed: Jul. 7, 1997

[30] Foreign Application Priority Data

Jul. 11, 1996 [DE] Germany ..... 196 27 882.1

[51] Int. Cl.[6] ..... D01H 9/18

[52] U.S. Cl. ..... 19/159 A

[58] Field of Search ..... 19/159 A, 159 R; 57/281

[56] References Cited

U.S. PATENT DOCUMENTS

| | | | |
|---|---|---|---|
| 3,221,374 | 12/1965 | Fornes . | |
| 3,249,968 | 5/1966 | Whitehurst | 19/159 A |
| 3,323,177 | 6/1967 | Binder et al. | 19/159 A |
| 3,323,178 | 6/1967 | Gossett et al. . | |
| 3,323,179 | 6/1967 | Gossett et al. . | |
| 3,729,776 | 5/1973 | Johns . | |
| 4,292,712 | 10/1981 | Bonner, Sr. . | |
| 4,653,263 | 3/1987 | Stahlecker et al. . | |
| 5,311,645 | 5/1994 | Schwalm et al. | 19/159 A |
| 5,682,647 | 11/1997 | Leifeld | 19/159 A |

FOREIGN PATENT DOCUMENTS

| | | | |
|---|---|---|---|
| 58 887 | 11/1967 | Germany . | |
| 113 373 | 6/1975 | Germany . | |
| 25 41 739 | 4/1976 | Germany . | |
| 33 24 461 | 10/1984 | Germany . | |
| 238 598 | 8/1986 | Germany . | |
| 628980 | 1/1987 | Japan | 19/159 A |
| 1029898 | 5/1966 | United Kingdom . | |
| 1136782 | 12/1968 | United Kingdom . | |
| 1 436 857 | 5/1976 | United Kingdom . | |
| 1 467 869 | 3/1977 | United Kingdom . | |
| 2 041 016 | 9/1980 | United Kingdom . | |

*Primary Examiner*—Ismael Izaguirre
*Attorney, Agent, or Firm*—Spencer & Frank

[57] ABSTRACT

A coiler can handling apparatus includes a platform rotatable about a substantially vertical platform axis for rotating a coiler can standing thereon; a travelling coiler can exchanger for moving a coiler can onto and moving a coiler can off the platform; and a centering device for centering a coiler can on the platform relative to the platform axis. The centering device includes first, second and third support rollers for engaging a lateral surface of the coiler can supported upright on the platform. The first, second and third support rollers lie on a common imaginary cylinder having a cylinder axis. The centering device further has a positioning arrangement for holding the first, second and third support rollers at the platform, apart from the travelling coiler can exchanger, whereby the coiler can exchanger travels without carrying therewith the first, second and third support rollers. The positioning arrangement includes a joint for movably holding the first and second support rollers to allow them to assume an inwardly pivoted position and an outwardly pivoted position. In the inwardly pivoted position the cylinder axis of the imaginary cylinder coincides with the platform axis.

6 Claims, 3 Drawing Sheets

APPARATUS FOR EXCHANGING COILER CANS AT A FIBER PROCESSING TEXTILE MACHINE

CROSS REFERENCE TO RELATED APPLICATION

This application claims the priority of German Application No. 196 27 882.1 filed Jul. 11, 1996, which is incorporated herein by reference.

BACKGROUND OF THE INVENTION

This invention relates to a coiler can handling apparatus and more particularly concerns a centering device for a coiler can which stands on a rotary can-supporting platform at a fiber processing textile machine such as a drawing frame or a carding machine. The coiler can may be placed on or removed from the rotary platform by a rotary coiler can exchanger essentially composed of a turnstile. The centering device which centers the coiler can on the rotary platform relative to the rotary platform axis includes at least three supporting rollers for engaging the lateral (vertical) surface of the standing coiler can.

According to a known device, disclosed, for example, in German Patent No. 3,324,461, three rotatable supporting rollers are secured to the coiler can exchanger. One of the supporting rollers is mounted on a spring-loaded arm which may be pivoted inwardly or outwardly. By rotating the coiler can exchanger, the coiler can is conveyed further, while it is grasped circumferentially by the three supporting rollers. The coiler can is transported in this manner onto and out of the rotary platform and is positioned thereon by the supporting rollers which travel with the coiler can exchanger. As a condition for a positive centering, the support rollers must have a uniform distance from the platform axis and furthermore must have a uniform angular spacing from one another. It is a disadvantage of this arrangement that the support rollers carried by the exchanger turnstile have certain tolerances. Also, a positive centering of this type of conventional device is interfered with by the fact that the coiler cans are often out of round. Also, the support rollers are, because of their conveying function, exposed to significant jars during the conveying motion, particularly when moving full cans.

SUMMARY OF THE INVENTION

It is an object of the invention to provide an improved device of the above-outlined type from which the discussed disadvantages are eliminated and which, in particular, provides for a positive centering of the coiler can and ensures that the support rollers are treated gently when impact-like stresses appear.

This object and others to become apparent as the specification progresses, are accomplished by the invention, according to which, briefly stated, the coiler can handling apparatus includes a platform rotatable about a substantially vertical platform axis for rotating a coiler can standing thereon; a travelling coiler can exchanger for moving a coiler can onto and moving a coiler can off the platform; and a centering device for centering a coiler can on the platform relative to the platform axis. The centering device includes first, second and third support rollers for engaging a lateral surface of the coiler can supported upright on the platform. The first, second and third support rollers lie on a common imaginary cylinder having a cylinder axis. The centering device further has a positioning arrangement for holding the first, second and third support rollers at the platform, apart from the travelling coiler can exchanger, whereby the coiler can exchanger travels without carrying therewith the first, second and third support rollers. The positioning arrangement includes a joint for movably holding the first and second support rollers to allow them to assume an inwardly pivoted position and an outwardly pivoted position. In the inwardly pivoted position the cylinder axis of the imaginary cylinder coincides with the platform axis.

The stationary support rollers are independent from the turnstile of the coiler can exchanger so that the support rollers serve solely for centering the coiler can. Since the support rollers are always at the same location in the inwardly pivoted position, a precise centering of the coiler can is possible. In contrast to conventional devices, the support rollers according to the invention are not exposed to undesired, impact-like stresses so that for this reason too, tolerances are avoided. By virtue of the separation of function between conveying and centering, it is possible to utilize the support rollers according to the invention solely for centering and thus the accuracy of the centering operation is improved. It is a further advantage of the invention that the structure may be realized with mechanical elements, for example, spring-loaded arms for the support rollers, without additional driving devices.

DESCRIPTION OF THE PREFERRED EMBODIMENTS

Figure 1A:
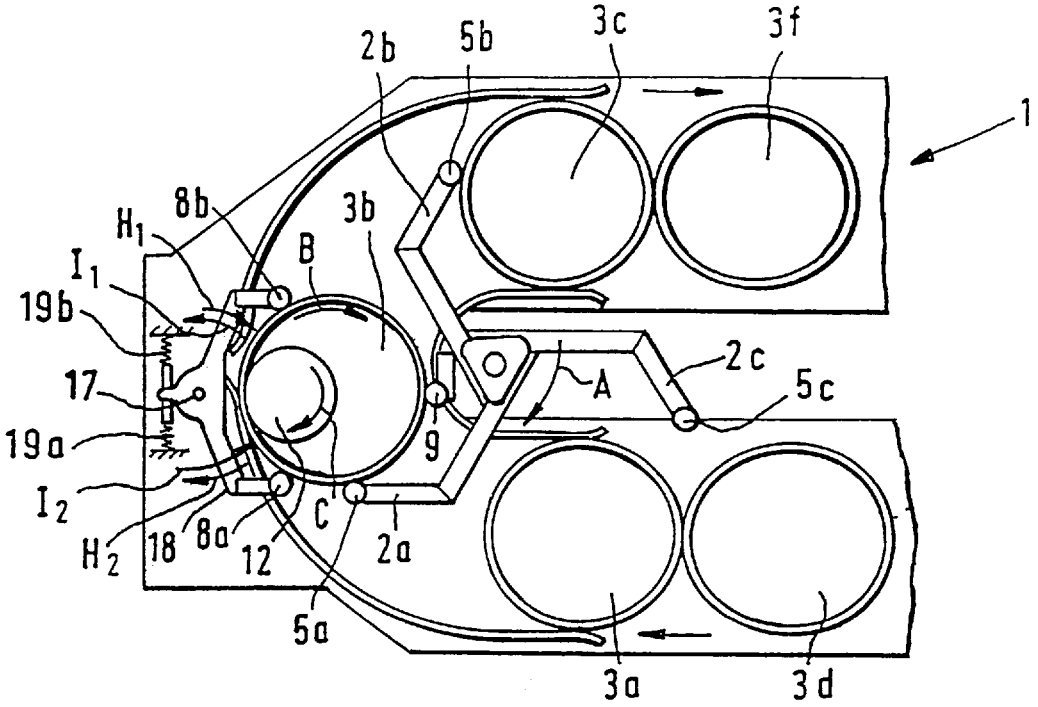
FIG. 1*a* is a schematic top plan view of a coiler can exchanger incorporating a first preferred embodiment of a centering device shown in an inwardly pivoted position.
Figure 1B:
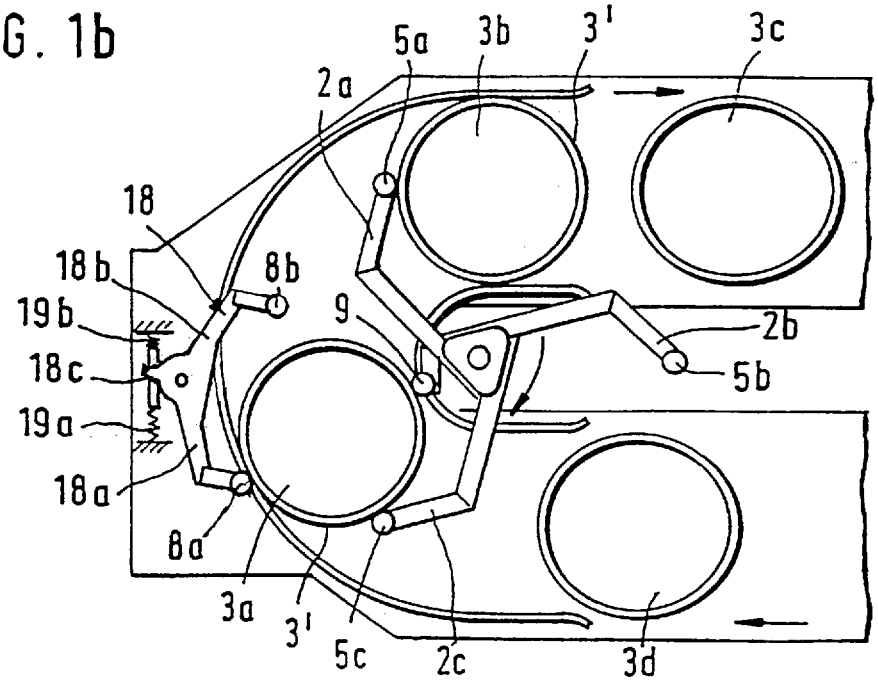
FIG. 1*b* is a view similar to FIG. 1*a*, illustrating the centering device in an inwardly pivoted position.
Figure 2:
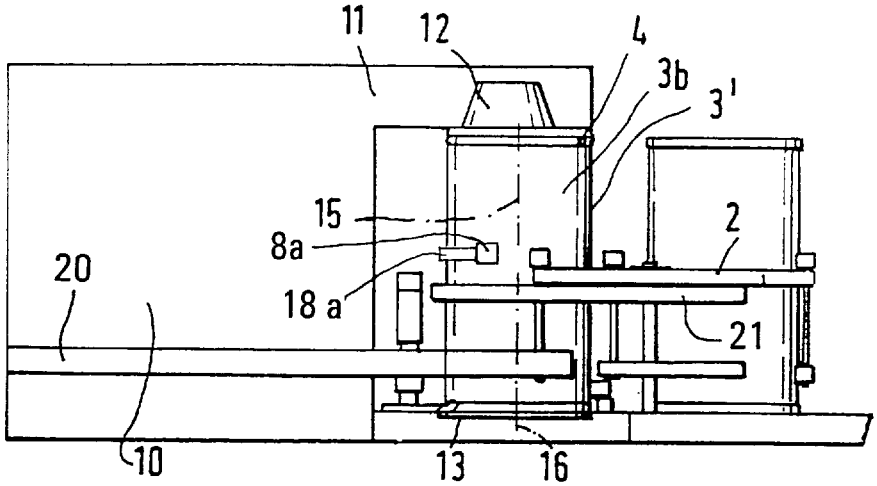
FIG. 2 is a schematic side elevational view of the structure shown in FIG. 1*a*.

FIGS. 1*a* and 1*b* show a coiler can exchanger 1 having a turnstile 2 composed of three arms 2*a*, 2*b* and 2*c* between which three respective coiler cans 3*a*, 3*b* and 3*c* are arranged. The turnstile 2 is rotated clockwise in the direction of the arrow A by a drive, not shown. In the illustration of FIG. 1*a* the coiler can 3*a* is empty, the coiler can 3*b* is being filled with sliver 4 by means of a rotary coiler head 12 forming part of an otherwise not illustrated sliver coiler apparatus, while the coiler can 3*c* is full. The can 3*b* is, as shown in FIG. 2, standing on a driven coiler can platform 13 and rotates together with the platform 13 clockwise in the direction of the arrow B. The can 3*b* is situated underneath the coiler head plate 11 which, in turn, supports the rotary coiler head 12 which rotates clockwise in the direction of the arrow C. In the position of the coiler can exchanger 1 depicted in FIG. 1*a*, the sliver 4 is deposited in coils from above into the can 3*b*. To effect a coiler can exchange (replacement), the turnstile 2 is, according to FIG. 1*b*, rotated in the direction of the arrow A, thus effecting a travel of the coiler cans 3*a*, 3*b* and 3*c*.

The outer end of arms 2*a*, 2*b* and 2*c* carry respective rollers 5*a*, 5*b* and 5*c* which are rotatable about respective vertical axes and which, during coiler can exchange (FIG. 1*b*), press against the side face 3' of the coiler cans 3*a*, 3*b*, 3*c*.

In the region of the coiler head 12 and the coiler can platform 13 a stationarily held joint 17 is arranged on which a two-arm, generally U-shaped lever element (rocker) 18 is mounted for rotary motions about a vertical axis for a clockwise pivotal motion in the direction of the arrows $H_1$, $H_2$ and a counterclockwise pivotal motion in the direction of the arrows $I_1$, $I_2$. To the end of arms 18*a* and 18*b* respective support rollers 8*a*, 8*b* are secured which are rotatable about their own vertical axis. The joint 17 and the lever element 18 are situated externally of the travelling path (rotational circle) of the turnstile 2. In the zone of the coiler head 12 and the coiler can platform 13 a stationary support roller 9 is arranged which is rotatable about its vertical axis. The support roller 9 is situated inside the rotational circle of the turnstile 2. The three support rollers 8*a*, 8*b* and 9 thus do not travel with the turnstile 2. The lever element 18 has in its middle a projection 18*c* which is loaded by two stationary, axially aligned and oppositely acting compression springs 19*a*, 19*b*.

FIG. 1*b* depicts the operational phase when a new coiler can 3*a* is moved into the position previously occupied by the coiler can 3*b*. Thus, due to the rotation of the turnstile 2, the arm 2*c* exerts a pressure on the lateral surface 3' of the coiler can 3*a* via the roller 5*c*. As a result, the coiler can 3*a* is shifted forwardly and presses against the roller 8*a* so that the lever arm 18*a* yields in the direction $H_2$ (FIG. 1*a*) against the force of the spring 19*b*. In this manner, the path for the coiler can 3*a* is rendered free and thus the coiler can 3*a* is moved further in the direction of the coiler head 12, whereupon the lever arm 18*a* is, under the effect of the spring 19*b*, pivoted back in the direction $I_2$. Thus, the coiler can 3*a* arrives by means of self-centering on the coiler can platform 13 in the sliver filling position underneath the coiler head 12.

The coiler can 3*a* is, by virtue of an outward pivoting of the dual lever element 18 in the direction of the arrows $I_1$, $H_2$ moved out of the filling position by the pressing force of the turnstile 2.

FIG. 2 shows a drawing frame 10 which may be, for example, an HS 1000 model high-performance drawing frame manufactured by Trützschler GmbH & Co. KG, M önchengladbach, Germany. The coiler can 3*b* is situated underneath the coiler head plate 11 which supports the coiler head 12. The coiler can 3*b* stands on the rotary coiler can platform 13.

Figure 3:
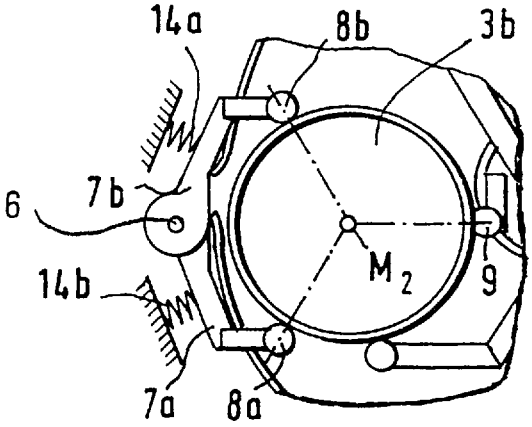
FIG. 3 is a schematic top plan view of a second preferred embodiment of the invention, illustrating the centering device in an inwardly pivoted position.
Figure 4:
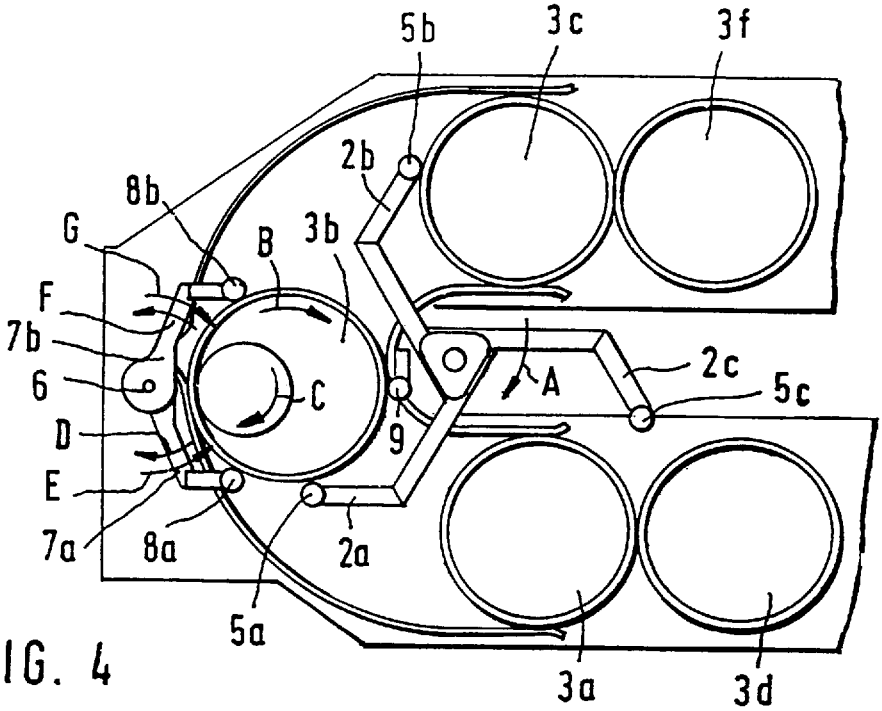
FIG. 4 is a schematic top plan view of a coiler can exchanger incorporating the second preferred embodiment of the centering device shown in an inwardly pivoted position, as in FIG. 3.

While according to the embodiment shown in FIGS. 1*a* and 1*b* the arms 18*a* and 18*b* form a rigid, one-piece component 18, in the embodiment according to FIGS. 3 and 4 the arms 7*a*, 7*b* carrying the respective support rollers 8*a* and 8*b* at one end, are mounted at their respective other end on a stationarily held joint 6 for pivotal motions about a common vertical axis independently from one another. FIGS. 3 and 4 show the arms 7*a*, 7*b* in an inwardly pivoted position. It is noted that in any pivotal position of the arms 7*a* and 7*b* the support rollers 8*a*, 8*b* and 9 may be considered as lying on an imaginary cylinder. In the inwardly-pivoted position of the arms 7*a* and 7*b* the three support rollers 8*a*, 8*b* and 9 lie on an imaginary cylinder, whose cylinder axis is designated at $M_2$. The arms 7*a*, 7*b* are biased by the springs 14*a* and 14*b* (for example, compression springs) against the lateral surface of the coiler can 3*b* which, in turn, is thus pressed against the stationary (non-pivotal) support roller 9 such that the cylinder axis $M_2$ and the turntable axis $M_1$ (which is designated at 16 in FIG. 2) coincide. As a result, the turntable axis $M_1$ coincides with the coiler can axis 15 of the coiler can 3*b*. This thus means that the coiler can 3*b* is centered relative to the coiler can platform 13 in the filling position and held in such a centered position by the support rollers 8*a*, 8*b* and 9. The coiler can platform 13 is driven by a non-illustrated motor in the direction indicated by the arrow K.

With particular reference to FIG. 4, when the turnstile 2 rotates and thus can replacement takes place, the coiler can 3*b* moves away from the platform 13 (visible in FIG. 2) and while doing so, pushes the roller 8*b* (and the arm 7*b*) out of the way, against the force of the spring 14*a*. At the same time, the turnstile 2 advances the coiler can 3*a* onto the platform 13 and while doing so, the coiler can 3*a* pushes the roller 8*a* (and the arm 7*a*) out of the way, against the force of the spring 14*b*. As the coiler can 3*a* assumes its position on the platform 13, the rollers 8*a*, 8*b*, urged by the respective springs 14*b* and 14*a* via the respective arms 7*a* and 7*b*, push the coiler can 3*a* against the roller 9, thus performing a centering operation.

As seen in FIG. 4, the arms 7*a*, 7*b* are rotatable in the direction indicated by the arrows D, E, F and G. As in the embodiment of FIGS. 1*a* and 1*b*, the joint 6 and the arms 7*a*, 7*b* are situated externally and the stationary (non-pivotal) support roller 9 is situated internally of the rotational circle of the turnstile 2.

Figure 5:
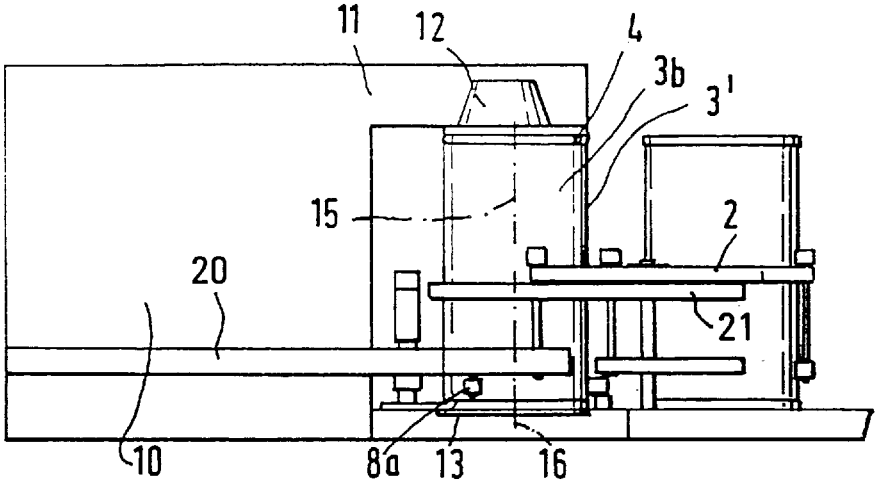
FIG. 5 is a schematic side elevational view similar to FIG. 2, showing a component of the FIG. 2 structure at a different location.

FIG. 5 shows a construction similar to FIG. 2, except that in FIG. 2 the centering device (of which only components 8*a* and 18*a* are shown) is situated above the guide rails 20, 21, in the arrangement of FIG. 5 the centering device (of which only component 8*a* is shown), is situated below the guide rails 20, 21. Locating the centering device below the guide rails 20, 21, that is, close to the coiler can bottom is particularly advantageous in case the coiler cans are not provided with wheels to thus avoid tilting of the coiler can when pushed by the centering device.

It will be understood that the above description of the present invention is susceptible to various modifications, changes and adaptations, and the same are intended to be comprehended within the meaning and range of equivalents of the appended claims.

What is claimed is:

1. A coiler can handling apparatus comprising (a) a platform rotatable about a substantially vertical platform axis for rotating a coiler can standing thereon;

(b) a travelling coiler can exchanger for moving a coiler can onto and moving a coiler can off said platform; and (c) a centering device for centering a coiler can on said platform relative to said platform axis; said centering device including (1) first, second and third support rollers for engaging a lateral surface of the coiler can supported upright on said platform; said first, second and third support rollers lying on a common imaginary cylinder having a cylinder axis; and (2) positioning means for holding said first, second and third support rollers at said platform, apart from said travelling coiler can exchanger, whereby said coiler can exchanger travels without carrying therewith said first, second and third support rollers; said positioning means including pivot means for movably holding said first and second support rollers to allow said first and second support rollers to assume an inwardly pivoted position and an outwardly pivoted position; in said inwardly pivoted position said cylinder axis coinciding with said platform axis; said pivot means including (i) a stationarily held joint having a rotary axis oriented parallel to said platform axis;

(ii) a lever assembly pivotally mounted on said joint and having rigidly interconnected first and second pivot levers carrying said first and second support rollers, respectively; and (iii) force-exerting means for urging said lever assembly to rotate about said rotary axis of said joint into said inwardly pivoted position; said force-exerting means including two oppositely working compression springs connected to said lever assembly.

2. The coiler can handling apparatus as defined in claim 1, wherein said first and second pivot levers together form a U-shaped component.

3. The coiler can handling apparatus as defined in claim 1, wherein said first, second and third support rollers have respective rotary axes oriented parallel to said platform axis.

4. A coiler can handling apparatus comprising (a) a platform rotatable about a substantially vertical platform axis for rotating a coiler can standing thereon;

(b) a travelling coiler can exchanger for moving a coiler can onto and moving a coiler can off said platform; and (c) a centering device for centering a coiler can on said platform relative to said platform axis; said centering device including (1) first, second and third support rollers for engaging a lateral surface of the coiler can supported upright on said platform; said first, second and third support rollers lying on a common imaginary cylinder having a cylinder axis; and (2) positioning means for holding said first, second and third support rollers at said platform, apart from said travelling coiler can exchanger, whereby said coiler can exchanger travels without carrying therewith said first, second and third support rollers; said positioning means including pivot means for movably holding said first and second support rollers to allow said first and second support rollers to assume an inwardly pivoted position and an outwardly pivoted position; in said inwardly pivoted position said cylinder axis coinciding with said platform axis; said pivot means including (i) a stationarily held joint having a rotary axis oriented parallel to said platform axis;

(ii) a lever assembly pivotally mounted on said joint; said lever assembly including first and second pivot levers movable independently from one another and carrying said first and second support rollers, respectively; and (iii) force-exerting means for urging said first and second levers to rotate about said rotary axis of said joint into said inwardly pivoted position.

5. The coiler can handling apparatus as defined in claim 4, wherein said first, second and third support rollers have respective rotary axes oriented parallel to said platform axis.

6. The coiler can handling apparatus as defined in claim 4, wherein said force-exerting means comprises a spring.

* * * * *